United States Patent [19]

Stevens et al.

[11] Patent Number: 4,633,199

[45] Date of Patent: Dec. 30, 1986

[54] HIGH POWER CIRCULATING

[75] Inventors: Robert Stevens, Melrose; Thomas Rosa, Danvers, both of Mass.

[73] Assignee: Alpha Industries, Inc., Woburn, Mass.

[21] Appl. No.: 678,298

[22] Filed: Dec. 5, 1984

[51] Int. Cl.[4] ..... H01P 1/39

[52] U.S. Cl. ..... 333/1.1; 333/125

[58] Field of Search ..... 333/1.1, 24.1, 24.2

[56] References Cited

U.S. PATENT DOCUMENTS

| | | | |
|---|---|---|---|
| 3,015,787 | 1/1962 | Allin et al. | 333/1.1 |
| 3,684,983 | 8/1972 | Cotter et al. | 333/1.1 |
| 3,873,944 | 3/1975 | Vaguine et al. | 333/1.1 |
| 3,928,824 | 12/1975 | Takahashi et al. | 333/1.1 |
| 4,145,672 | 3/1979 | Piotrowski | 333/1.1 |

*Primary Examiner*—Paul Gensler

*Attorney, Agent, or Firm*—Charles Hieken

[57] ABSTRACT

In a microwave circulator having a ferrite core axially aligned along the axis of a junction of waveguides and surrounded by an insulating sleeve seated in counterbores in opposed metal transformers seated in opposed waveguide broad walls, one end of the ferrite core is highly polished and bonded with a silver epoxy to one of the metal transformers and spaced from the other by an insulating disk. Opposed rare-earth cylindrical magnets embedded in the broad wall axially aligned along the junction axis bias the ferrite core and establish a magnetic field along the junction axis inside the ferrite core.

8 Claims, 1 Drawing Figure

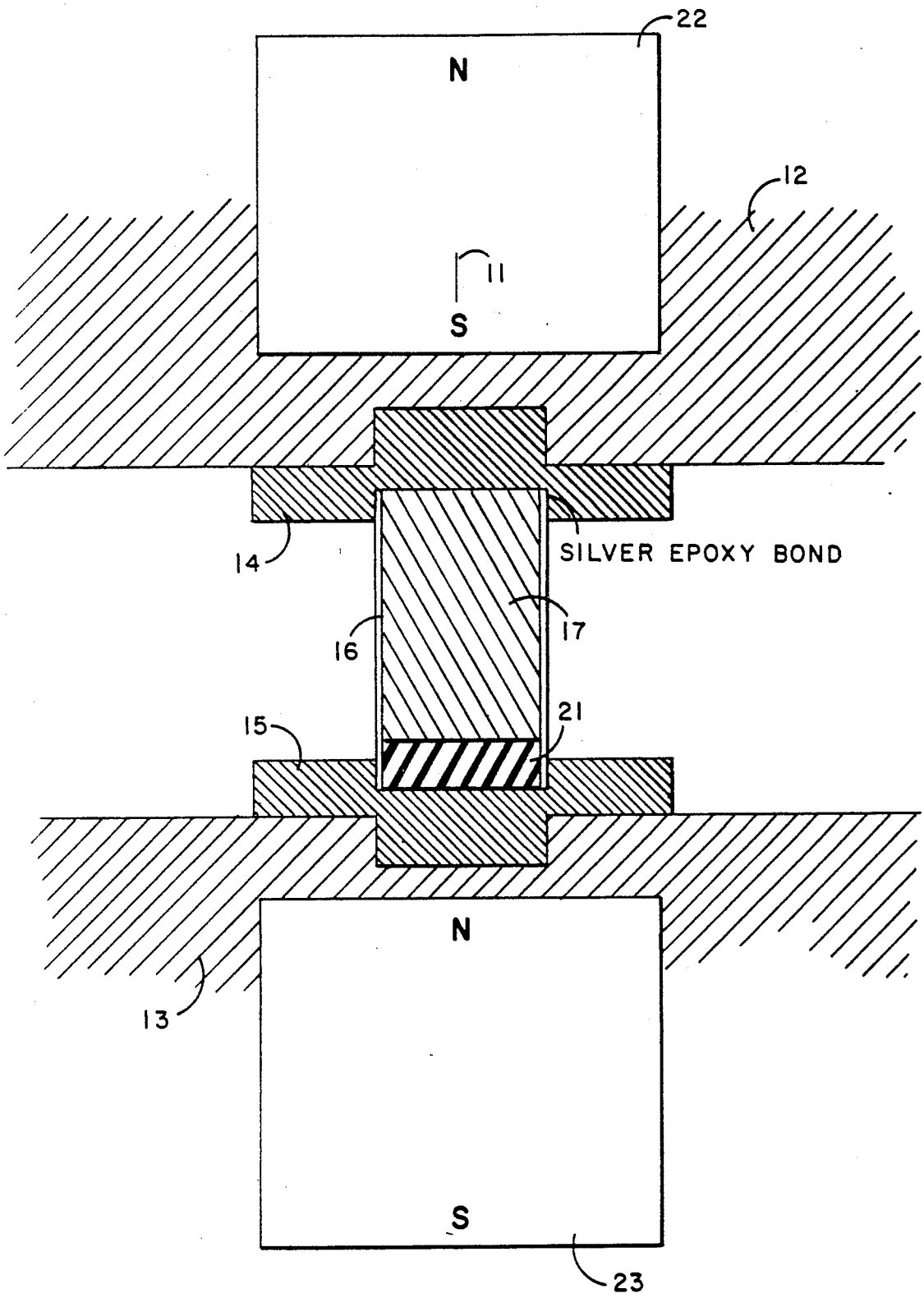
22
N
12
11
S
14
SILVER EPOXY BOND
16
17
15
21
N
13
S
23

HIGH POWER CIRCULATING

The present invention relates in general to circulating and more particularly concerns a novel waveguide circulator characterized by circulating relatively high power levels while otherwise maintaining good electrical characteristics, such as relatively high isolation, relatively low VSWR and relatively low insertion loss.

The present invention represents an improvement over the waveguide circulator described in an article in IEEE TRANSACTIONS ON MICROWAVE THEORY AND TECHNIQUES for November 1976, pp. 863–866 entitled "Low Loss Broad-Band EHF Circulator" by W. S. Piotrowski and J. E. Raue. That article describes a circulator comprising cylindrical ferrites symmetrically located at the junction of three rectangular waveguides inside a dielectric sleeve having dielectric coupling spacers at each end seated in recesses of metallic matching transformers. The symmetrically located ferrites are separated by a thin reflecting septum, typically produced by plating the adjacent faces of the ferrite cylinder with conducting material, or by a copper shim about 0.002 in. thick to short circuit the contiguous end of each ferrite cylinder. A magnetic field typically produced by strong permanent magnets at the top and bottom of the circulator produce a biasing magnetic field along the ferrite axis. A disadvantage of this prior art structure is its limited power handling capability.

It is an important object of this invention to provide an improved ferrite waveguide circulator.

According to the invention, in a waveguide circulator having opposed conducting metal transformers in contact with opposed broad waveguide walls, a ferrite element is asymmetrically located in thermally conductive contact with one of the metal transformers, typically with a silver epoxy bond and separated from the other metal transformer by an insulating spacer, typically of Teflon.

Numerous other features, objects and advantages of the invention will become apparent from the following specification when read in connection with the accompanying drawing, the single FIGURE of which is a sectional view diagrammatically illustrating the relationship of the elements relative to the circulator broad walls and the magnets providing a magnetic biasing field.

With reference now to the drawing, there is shown a diagrammatic sectional view of a circulator junction according to the invention. Since the improved portion exhibits circular symmetry, the sectional view shown best and fully illustrates the invention, it being understood that the physical structure typically comprises three rectangular waveguides equiangularly spaced about the junction axis 11 having upper and lower conducting broad walls 12 and 13. Upper and lower metal transformers 14 and 15 are formed with a cylindrical cap seated in a mating opening in upper and lower broad walls 12 and 13, respectively, and formed with central circular counterbores accommodating Teflon sleeve 16. A ferrite rod 17, typically of TT 2-111 ferrite material commercially available from Trans-Tech, Inc., abuts metal transformer 14 in good thermal contact therewith, such as by means of a silver epoxy bond or other selectively and thermally conductive bonding material. The lower end of ferrite rod 17 is separated from lower metal transformer 15 by solid insulating spacer 21, typically Teflon filling the space therebetween. Upper and lower cylindrical permanent magnets 22 and 23 are seated in mating counterbores in upper and lower broad walls 12 and 13 axially aligned with junction axis 11 and poled to aid each other in establishing a static magnetic biasing field along the axis 11.

The invention has a number of advantages and uses. It exhibits broadband high performance characteristics in a lightweight body while handling considerable power. The invention may be used for numerous applications, including satellite communications and other applications where high power handling capabilities with a compact relatively lightweight structure is important.

The invention may be assembled by a compression fit in standard height waveguide which secures the assembly in the junction. The use of a single ferrite rod 17 reduces losses. The assembly of dielectric sleeve 16, ferrite rod 17 and insulating disk 21 residing in counterbores of transformers 14 and 15 further enhances the mechanical integrity. This self-jigging feature also assures alignment of the ferrite rod 17 and insulating disk 21, thereby facilitating production of reliable assemblies relatively inexpensively with relatively unskilled labor. Highly polishing the upper surface of ferrite rod 17 helps establish good thermal contact with upper transformer 14, further enhanced by a silver epoxy bonding. Plating upper transformer 14 and lower transformer 15 with gold over copper allows matching transformers 14 and 15 to be soldered to the aluminum broad walls 12 and 13, further enhancing heat transfer from the assembly through the aluminum body into the atmosphere. The aluminum broad walls are preferably plated with zinc chromate, copper/nickel/gold. The transformers may also be plated with silver.

In a specific embodiment of the invention for operation centered in WR19 waveguide at 44.5 GHz, $\lambda_g$=0.3742 inches. The height of transformers 14 and 15 penetrating into the junction below the broad walls was 0.053 $\lambda_g$, approximately $\lambda_g/20$ or its diameter/10, its diameter typically being $\lambda_g/2$. The height of ferrite 17 was typically 0.134 $\lambda_g$ and its diameter 0.147 $\lambda_g$. Insulating disk 21 preferably has a diameter slightly less than that of ferrite rod 17 to allow for expansion when compressed by the waveguide block halves and a height sufficient to allow for slight compression of the parts when assembled, typically 0.037 $\lambda_g$. The thickness of insulating sleeve 16 may vary substantially and even be removed without substantial effect on electrical performance. A typical wall thickness is 0.019 $\lambda_g$ and of sleeve height, 0.171 $\lambda_g$. Similar relations are applicable for waveguide bands where the ratio of guide width to guide height is in the order of approximately 2. Furthermore the diameters of all the pieces may be reduced or increased to shift the frequency response, and the height of ferrite rod 17 may be changed to change the magnetic field or mode of operation. An actual embodiment of the invention obtained a VSWR of less than 1.3 at all three ports over frequency range of at least 40.0–46.5 GHz, an isolation between ports of at least 20 dB over a frequency range of at least 5 GHz and an insertion loss of no greater than 0.3 dB over the frequency range of interest.

The invention is described in an article entitled, "WR22 Circulator Uses Asymmetrical Ferrite Design" in MICROWAVE JOURNAL for October 1984, pp. 167–68.

There has been described novel apparatus and techniques for microwave circulating characterized by relatively high isolation, relatively low VSWR, relatively low insertion loss and high power handling capabilities with a compact lightweight structure that is relatively easy and inexpensive to fabricate with relatively unskilled personnel. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. In a microwave circulator having opposed metal transformers exhibiting circular symmetry in contact with opposed conducting broad walls of intersecting waveguides embracing a junction axis the improvement comprising, a cylindrical ferrite core in thermal conducting contact with one of said metal transformers, and a solid cylindrical insulating member filling the space between said ferrite core and the other of said metal transformers.

2. The improvement in accordance with claim 1 wherein the end face of said ferrite core in contact with said one metal transformer is highly polished.

3. The improvement in accordance with claim 2 wherein the end face of said ferrite core is bonded to said one metal transformer with an electrically and thermally conducting bonding material.

4. The improvement in accordance with claim 1, and further comprising a cylindrical insulating sleeve surrounding said ferrite core and said solid insulating member and seated in opposed circular counterbores in said opposed metal transformers.

5. The improvement in accordance with claim 2, and further comprising a cylindrical insulating sleeve surrounding said ferrite core and said solid insulating member and seated in opposed circular counterbores in said opposed metal transformers.

6. The improvement in accordance with claim 3, and further comprising a cylindrical insulating sleeve surrounding said ferrite core and said solid insulating member and seated in opposed circular counterbores in said opposed metal transformers.

7. The improvement in accordance with claim 1 wherein the height of said transformers penetrating into the junction inside said broad walls is substantially 1/20 the guide wavelength of said intersecting waveguides.

8. The improvement in accordance with claim 1, wherein said solid insulating member has a diameter slightly less than that of said ferrite core for allowing expansion when compressed and a height sufficient to allow for slight compression when assembled.

* * * * *